US007303485B2

(12) United States Patent
Tseng

(10) Patent No.: US 7,303,485 B2
(45) Date of Patent: Dec. 4, 2007

(54) SHOCK-ABSORBING GOLF CLUB HEAD

(75) Inventor: Wen-Cheng Tseng, 14F, No. 66, Kuanghua 2 Rd., Chienchen Dist., Kaohsiung (TW)

(73) Assignees: Wen-Cheng Tseng (TW); Kung-Wen Lee (TW); Super Way Technology Co., Ltd. (TW)

( * ) Notice: Subject to any disclaimer, the term of this patent is extended or adjusted under 35 U.S.C. 154(b) by 209 days.

(21) Appl. No.: 11/018,266

(22) Filed: Dec. 21, 2004

(65) Prior Publication Data

US 2005/0143188 A1 Jun. 30, 2005

(30) Foreign Application Priority Data

Dec. 31, 2003 (TW) ..... 92137595 A

(51) Int. Cl.
*A63B 53/04* (2006.01)

(52) U.S. Cl. ..... 473/332; 473/346; 473/350; 473/345

(58) Field of Classification Search ..... 473/324–350
See application file for complete search history.

(56) References Cited

U.S. PATENT DOCUMENTS

| | | | | |
|---|---|---|---|---|
| 5,178,392 | A * | 1/1993 | Santioni | 273/153 R |
| 5,586,948 | A * | 12/1996 | Mick | 473/332 |
| 5,766,092 | A * | 6/1998 | Mimeur et al. | 473/329 |
| 6,306,048 | B1 * | 10/2001 | McCabe et al. | 473/333 |
| 6,991,560 | B2 * | 1/2006 | Tseng | 473/332 |

* cited by examiner

*Primary Examiner*—Eugene Kim
*Assistant Examiner*—Alvin A Hunter
(74) *Attorney, Agent, or Firm*—Jackson Walker, LLP

(57) ABSTRACT

A shock-absorbing golf club head has a head body, an inner cap, a faceplate and a shock-absorbing core. The head body has an open front, an air cavity and a core cavity. The core cavity has a cavity shoulder. The inner cap is mounted securely on the cavity shoulder of the core cavity. The faceplate is mounted in the open front of the head body and is separated from the inner cap. The shock-absorbing golf club head effectively absorbs shock and generates a sound when striking a golfball.

4 Claims, 6 Drawing Sheets

SHOCK-ABSORBING GOLF CLUB HEAD

BACKGROUND OF THE INVENTION

1. Field of the Invention

The present invention relates to a golf club head, and particularly to a shock-absorbing golf head that effectively absorbs shock and generates a sound when striking a golf ball.

2. Description of Related Art

In recent years, golf has become so popular that golf equipment has undergone major modernization and improvements. Golf clubs are the most important pieces of golf equipment, and the structure of the golf club head influences the trajectory of a golf hall struck by the golf club head.

Many conventional golf club heads are hollow and generate a sound when striking a golf ball. However, deformation and rebounding of the hollow golf club head creates a shock when the golf club head strikes the golf ball, which is transmitted to a golfer and makes the golfer feel uncomfortable.

With reference to FIGS. 3 and 4 a conventional shock-absorbing golf club head has been developed to absorb shock when the golf club head strikes a golf ball. The shock-absorbing golf club head has a head body (20), a faceplate (24) and a shock-absorbing core (23).

The head body (20) has a crown, a sole, a shank, a toe, an open front, a core cavity (21) and a core cavity port (22). The open front has an inner shoulder. The core cavity (21) is defined in the head body (20) and communicates with the open front. The core cavity port (22) is defined through the crown and communicates with the core cavity (21) in the head body (20).

The faceplate (24) is mounted on the inner shoulder of the open front of the head body (20).

The shock-absorbing core (23) is resilient foam, is mounted in the core cavity (21) and tightly abuts the faceplate (24). To mount the shock-absorbing core (23) in the head body (20), resilient foam is injected through the core cavity port (22) to fill the core cavity (21).

However, the shock-absorbing core (23) abutting the faceplate (24) attenuates sound of the golf club head striking a golf ball so much that people cannot hear the sound.

With reference to FIG. 5 and 6, another conventional golf club head has been developed to absorb shock and generate an impact sound when the golf club head strikes a golf ball. The golf club head has a head body (30), a shock-absorbing core (31) and a faceplate (33).

The head body (30) has a crown, a sole, a shank, a toe, an open front, an air cavity and a core cavity (32). The open front has an inner shoulder. The air cavity is defined in the head body (30) near the crown and communicates with the open front. The core cavity (31) is de fined in the head body (30) near the sole, communicates with the open front and has a volume.

The shock-absorbing core (31) is rubber and is stuffed into the core cavity (32) and has a volume larger then that the volume of the core cavity (31).

The faceplate (33) is mounted on the inner shoulder of the open front of the head body (30) and presses the shock-absorbing core (33).

When a golf ball is struck, the shock-absorbing core (31) absorbs shock, and the air cavity generates an impact sound. However, pressing the shock-absorbing wadding (31) with the faceplate (33) results in deformation of the shock-absorbing core (31) and reduction of the shock-absorbing effect of the shock-absorbing core (31). In addition, the shock-absorbing core (31) directly in contact with the faceplate (33) reduces the impact sound so much that the impact sound may not be audible.

To overcome the shortcomings, the present invention provides a shock-absorbing golf club head to mitigate or obviate the aforementioned problems.

SUMMARY OF THE INVENTION

The main objective of the invention is to provide a shock-absorbing golf club head that effectively absorbs shock and generates an impact sound when striking a golf ball.

A shock-absorbing golf club head in accordance with the present invention has a head body, an inner cap, a faceplate and a shock-absorbing core.

The head body has an open front, an air cavity and a core cavity. The core cavity has a shoulder.

The inner cap is mounted securely on the shoulder of the core cavity.

The faceplate is mounted in the open front of the head body and is separated from the inner cap.

Other objectives, advantages and novel features of the invention will become more apparent from the following detailed description when taken in conjunction with the accompanying drawings.

BRIEF DESCRIPTION OF THE DRAWINGS

FIG. 3 is an exploded perspective view of a conventional shock-absorbing golf club head in accordance with the prior at;

DETAILED DESCRIPTION OF PREFERRED EMBODIMENT

Figure 1:
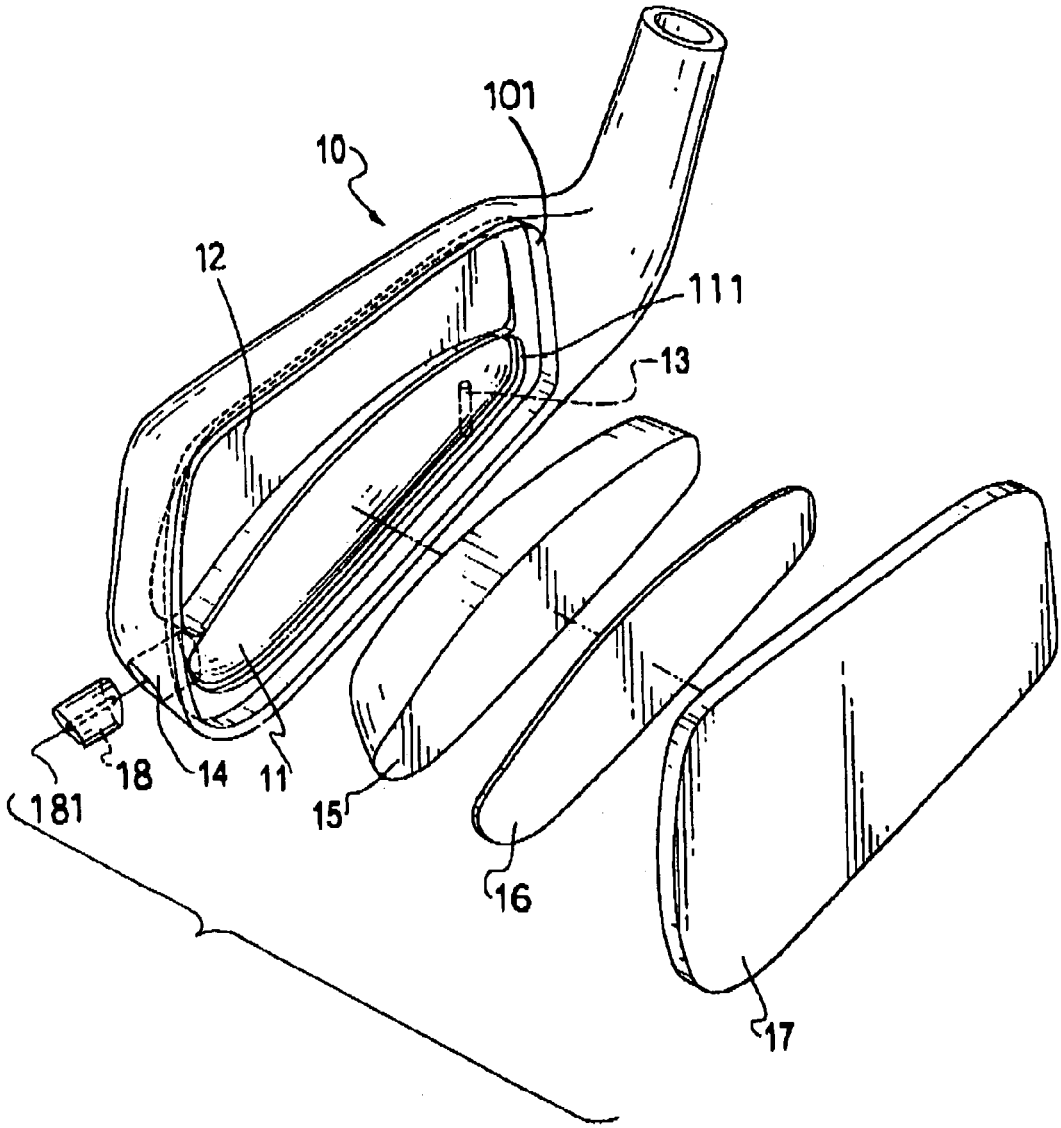
FIG. 1 is an exploded perspective view of a shock-absorbing golf club head in accordance with the present invention.
Figure 2:
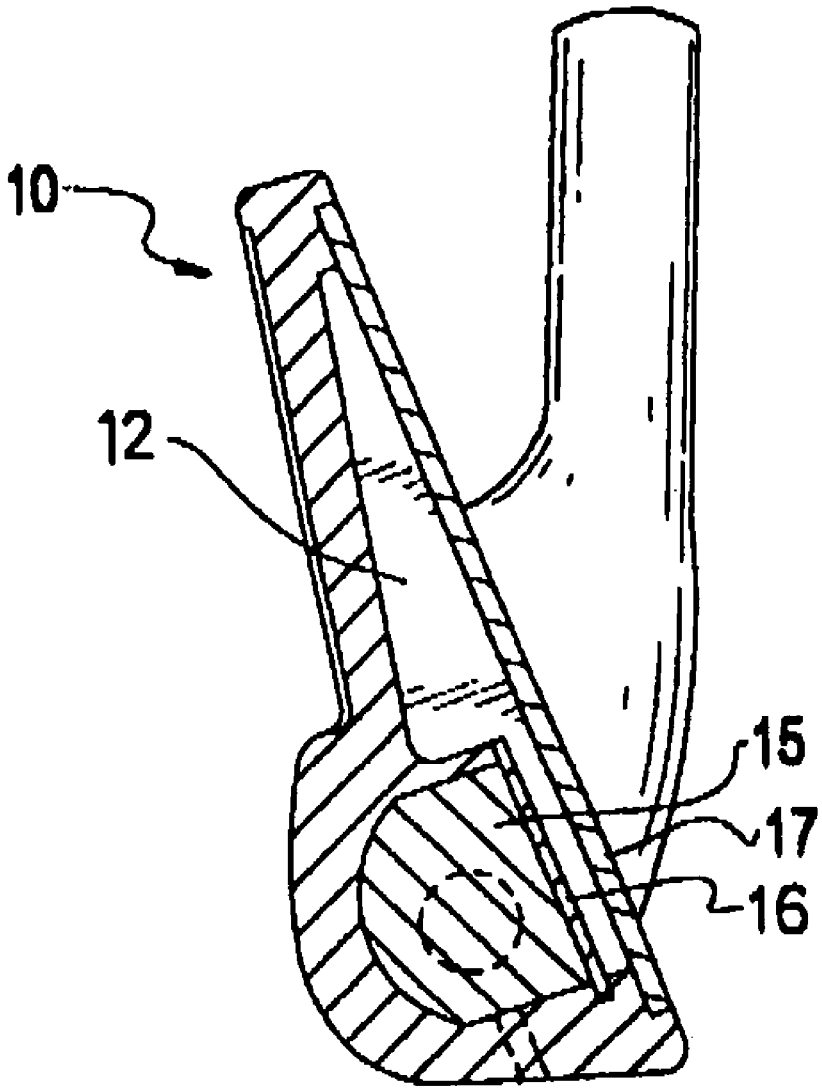
FIG. 2 is a cross sectional end view of the shock-absorbing golf club head in FIG. 1.
Figure 3:
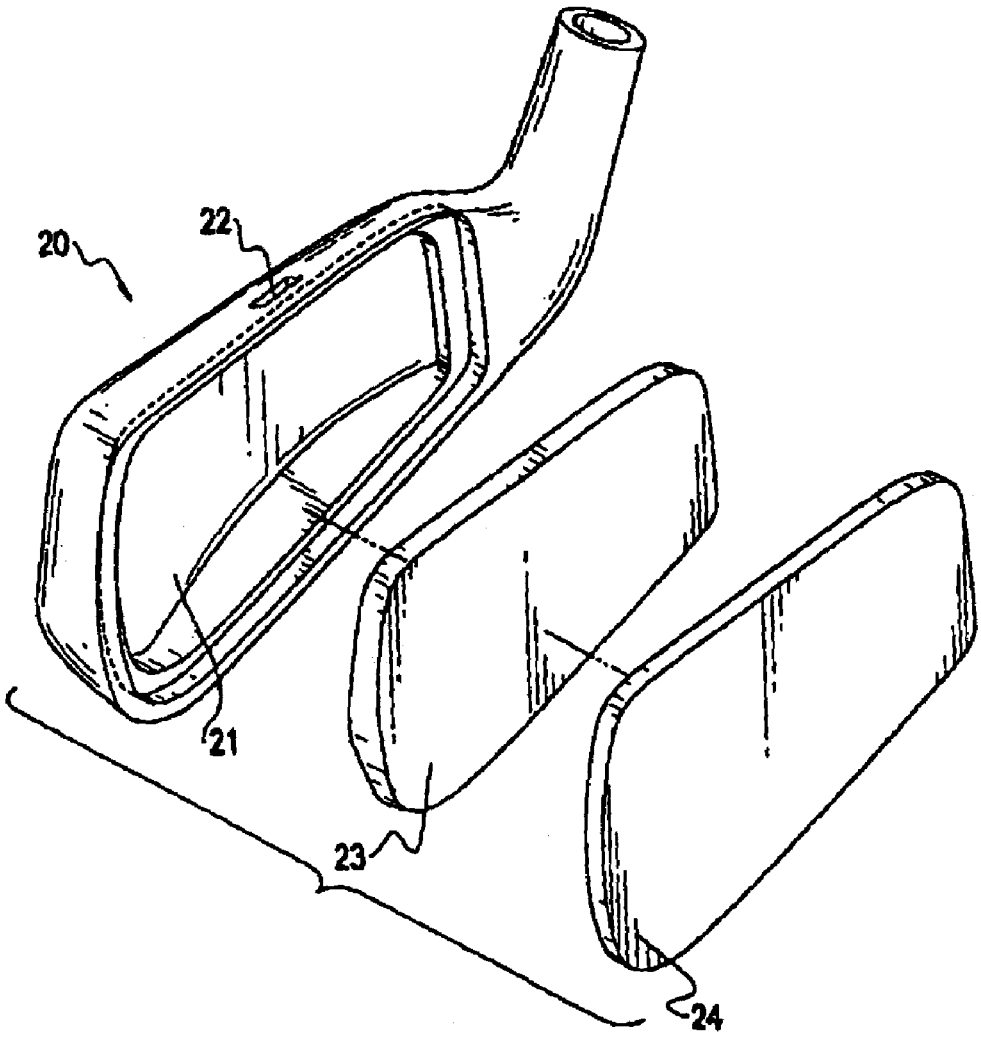
FIG. 3 PRIOR ART
Figure 4:
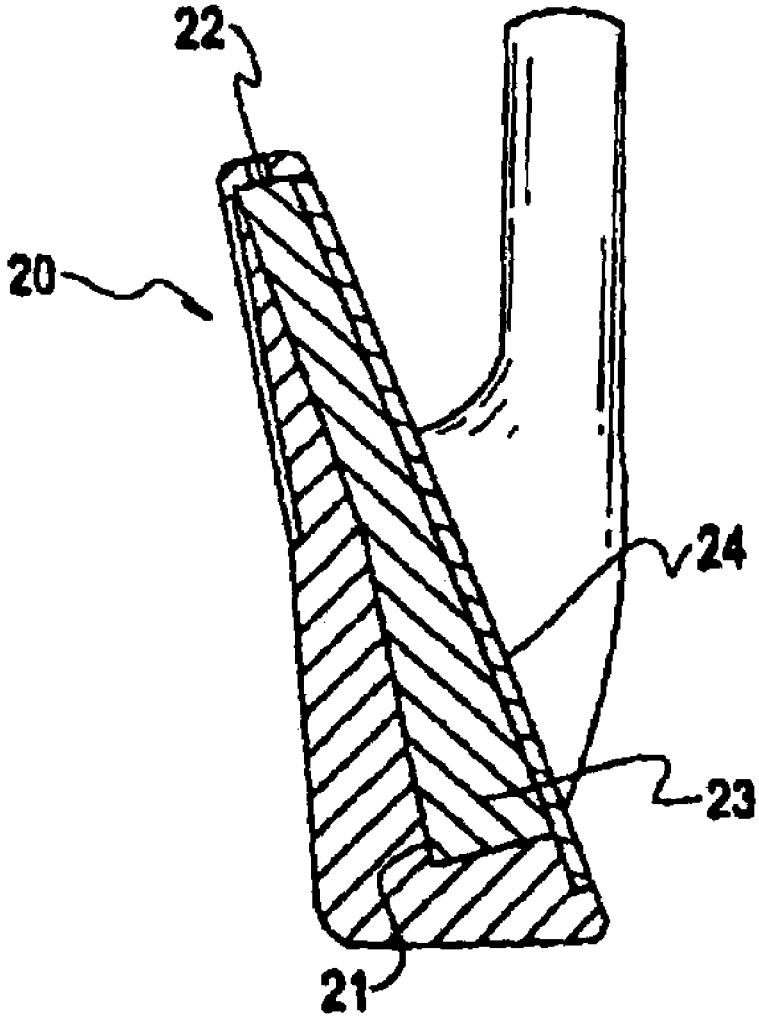
FIG. 4 PRIOR ART
FIG. 4 is a cross sectional end view of the conventional shock-absorbing golf club head in FIG. 3.
Figure 5:
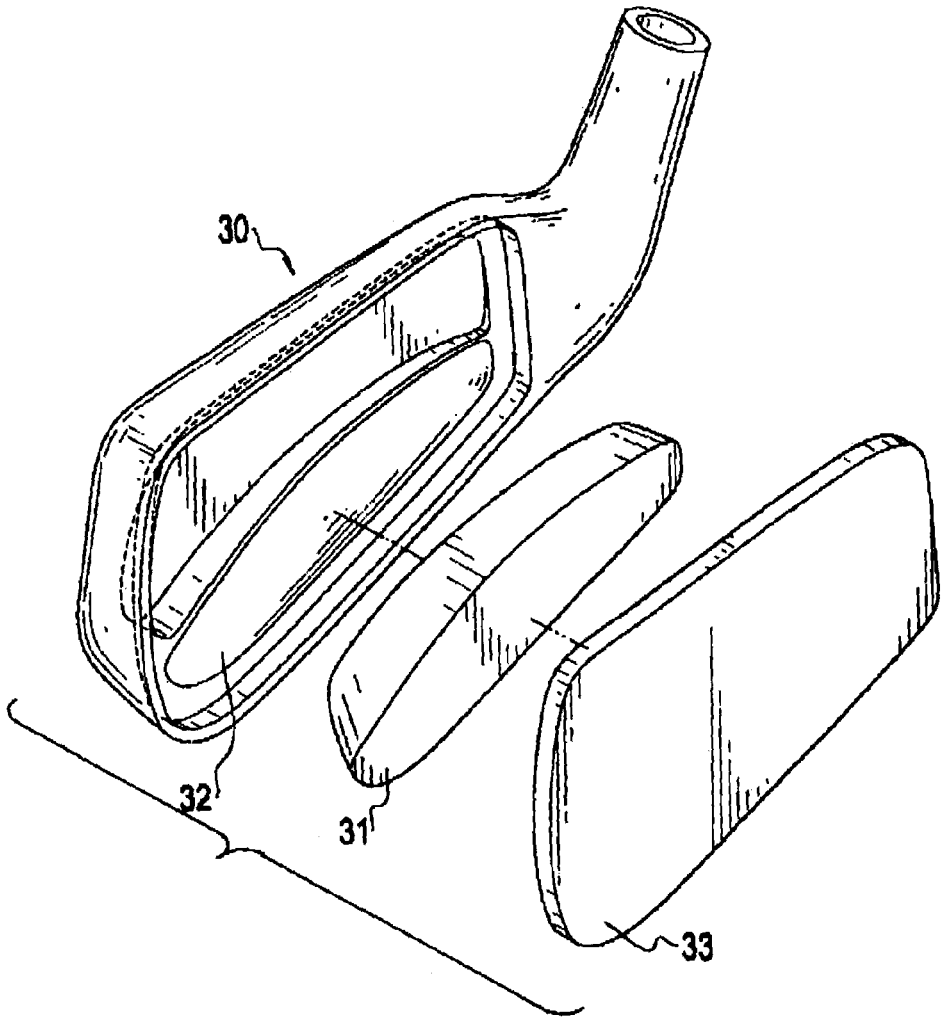
FIG.5 PRIOR ART
FIG. 5 is an exploded perspective view of another conventional shock-absorbing golf club head in accordance with the prior art.
Figure 6:
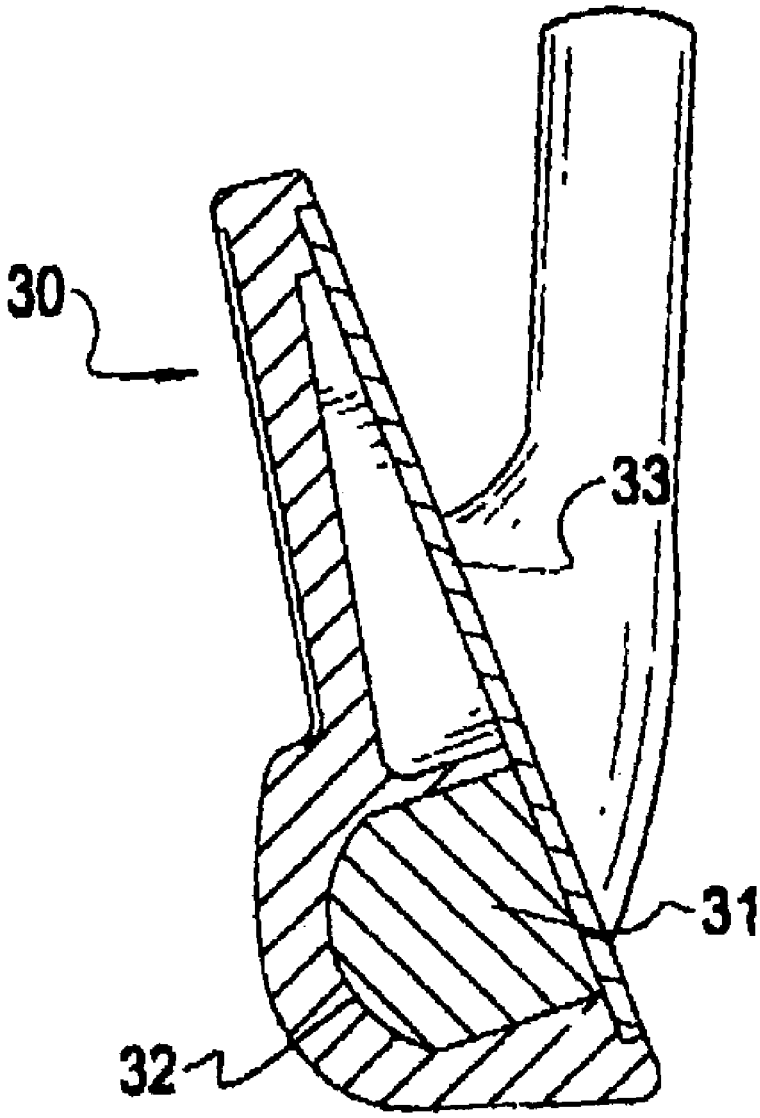
FIG.6 PRIOR ART
FIG. 6 is a cross sectional end view of the conventional shock-absorbing golf club head in FIG. 5.

With reference to FIGS. 1 and 2, a shock-absorbing golf club head in accordance with the present invention comprises a head body (10), an inner cap (16), a faceplate (17), a shock-absorbing core (15) and an optional plug (18).

The head body (10) has a crown, a sole, a shank, a toe, an open front, an air cavity (12), a core cavity (11), an optional air outlet (13) and a core port (14).

The open front of the head body (10) has an inner shoulder (101).

The air cavity (12) is defined in the head body (10) close to the crown and communicates with the open front.

The core cavity (11) is defined in the head body (10) close to the sole, communicates with the open front and has an inner surface and a cavity shoulder (111). The cavity shoulder (111) is defined in the inner surface of the core cavity (11) close to the open front. The air outlet (13) is defined through the head body (10) close to the shank and communicates with the core cavity (11). The core port (14) is defined through the head body (10) close to the toe and communicates with the core cavity (14).

The inner cap (16) has an outer edge mounted securely in the cavity shoulder (111) in the core cavity (11) by welding the outer edge of the inner cap (16) to the cavity shoulder (111) of the core cavity (11).

The faceplate (17) has an outer edge mounted securely on the inner shoulder (101) in the open front of the head body (10) by welding the outer edge of the faceplate (17) to the inner shoulder (101) of the open front. The faceplate (17) is separated from the inner cap (16).

The shock-absorbing core (17) is made of resilient foam and is mounted in the core cavity (11) and tightly abuts the inner cap (16). To mount the shock-absorbing core (23) in the head body (20), an appropriate quantity of resilient foam is injected through the core port (14) to fill the core cavity (11) and simultaneously the air inside the core cavity (11) is discharged to the ambient atmosphere through the optional air outlet (13). The resilient foam foams, fills the core cavity (11) and tightly abuts the inner cap (16).

The plug (18) is plugged into the core port (14) and has an optional ventilation hole (181) defined through the plug (18) and communicating with the core cavity (11).

When the faceplate (17) of the golf club head strikes a golf ball, part of the shock is transmitted to the air cavity (12) to generate an impact sound. The remaining shock is absorbed by the shock-absorbing core (15). The separation between the inner cap (16) and the faceplate (17) prevents the shock-absorbing core (11) from absorbing too much shock and ensures an appropriate impact sound is generated.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A shock-absorbing golf club head comprising:

a head body having
- a crown;
- a sole;
- a shank;
- a toe;
- an open front having an inner shoulder;
- an air cavity defined in the head body close to the crown and communicating with the open front;
- a core cavity defined in the head body close to the sole, communicating with the open front and having an inner surface; and
  - a cavity should defined in the inner surface of the core cavity close to the open front; and
- a core port defined through the head body close to the toe and communicating with the core cavity;

an inner cap being mounted securely and sealed in the air cavity and having an outer edge mounted securely in the cavity shoulder of the core cavity;

a faceplate being mounted securely on the open front of the head body, sealing the inner cap in the air cavity, being separated from the inner cap by an interval and having an outer edge mounted securely on the inner shoulder of the open front of the head body;

a shock-absorbing core being resilient foam, mounted in the core cavity, separated from the faceplate by the inner cap and tightly abutting the inner cap; and a plug plugged into the core port and having a ventilation hole defined through the plug and communicating with the core cavity.

2. The shock-absorbing golf club head as claimed in claim 1, wherein the outer edge of the inner cap is welded to the shoulder of the core cavity.

3. The shock-absorbing golf club head as claimed in claim 1, wherein the head body has an air outlet defined through the head body close to the shank and communicating with the core cavity.

4. The shock-absorbing golf club head as claimed in claim 2, wherein the head body has an air outlet defined through the head body close to the shank and communicating with the core cavity.

* * * * *